US010557600B1

(12) United States Patent
South

(10) Patent No.: US 10,557,600 B1
(45) Date of Patent: Feb. 11, 2020

(54) IN-GROUND CHANNEL SYSTEMS FOR LINEAR LIGHTING

(71) Applicant: Elemental LED, Inc., Reno, NV (US)

(72) Inventor: Daniel South, Dayton, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 16/654,352

(22) Filed: Oct. 16, 2019

(51) Int. Cl.

| | |
|---|---|
| ***F21S 8/02*** | (2006.01) |
| ***F21V 33/00*** | (2006.01) |
| ***F21V 21/02*** | (2006.01) |
| ***F21V 17/16*** | (2006.01) |
| ***F21V 15/01*** | (2006.01) |
| ***F21V 21/04*** | (2006.01) |
| *F21W 111/02* | (2006.01) |

(52) U.S. Cl.
CPC ..... *F21S 8/022* (2013.01); *F21V 15/01* (2013.01); *F21V 17/164* (2013.01); *F21V 21/025* (2013.01); *F21V 21/04* (2013.01); *F21V 33/006* (2013.01); *F21W 2111/02* (2013.01)

(58) Field of Classification Search
CPC ..... F21S 8/022; F21V 17/164; F21V 33/006; F21V 15/01
See application file for complete search history.

(56) References Cited

U.S. PATENT DOCUMENTS

| | | | | |
|---|---|---|---|---|
| 2014/0049954 | A1* | 2/2014 | Ladstaetter | F21S 4/20 362/221 |
| 2015/0345722 | A1* | 12/2015 | Cavaliere | F21S 8/022 362/382 |
| 2015/0369469 | A1* | 12/2015 | Vamberi | F21S 8/022 362/153.1 |
| 2017/0114989 | A1* | 4/2017 | Salazar | F21V 21/14 |

OTHER PUBLICATIONS

Hi-Line Lighting, Ltd., "Walk over and drive over LED profile." Internet. Available at https://www.hiline-lighting.co.uk/gb/index.php?controller=attachment&id_attachment=153 Version of May 30, 2018.

* cited by examiner

*Primary Examiner* — Evan P Dzierynski
(74) *Attorney, Agent, or Firm* — United IP Counselors, LLC

(57) ABSTRACT

An in-ground channel for linear lighting is disclosed. In the channel, two upright sidewalls are spaced apart by a bottom. Each of the sidewalls has an inwardly-extending upper support flange proximate to an upper end. The inwardly-extending upper support flanges are aligned with one another on respective sidewalls. A shelf is mounted between the two upright sidewalls at a position below the inwardly-extending support flanges. The shelf divides the in-ground channel into an upper section and a lower section. The upper section houses linear lighting and the lower section provides a raceway. The channel has only a single mounting flange attached to one of the two sidewalls at a position level with the bottom. The channel typically also includes a cover adapted to engage the upper support flanges. The shelf may be removable, mounted via a pair of inwardly-extending lower support flanges, for access to the lower section.

20 Claims, 10 Drawing Sheets

IN-GROUND CHANNEL SYSTEMS FOR LINEAR LIGHTING

TECHNICAL FIELD

The invention relates to in-ground channel systems for linear lighting.

BACKGROUND

Linear lighting is a type of lighting based on light-emitting diodes (LEDs) in which a long, narrow printed circuit board (PCB) has LED light engines mounted on it, spaced at a regular interval or pitch. The PCB may be either rigid or flexible and may also include other circuit elements, like resistors and current controllers, if needed to drive the LED light engines. By joining short sections of PCB, linear lighting can be manufactured to virtually any length.

Various types of channels are used to protect linear lighting and to direct the light that it emits. These channels may be designed for indoor use, for outdoor use, or for both. In recent years, in-ground channels have appeared on the market. These channels are typically extruded aluminum profiles that are flanged on each side at the bottom, so that they can be paved over. Linear lighting is placed in the channel, and it is typically covered with a so-called "drive over" outer lens that can withstand physical force.

In-ground channels face myriad issues in their design and use. Adequate drainage, access to and installation of wiring, and ease of installation are all potential issues.

SUMMARY OF THE INVENTION

One aspect of the invention relates to an in-ground channel for linear lighting. In the channel, two upright sidewalls are spaced apart by a bottom. Each of the sidewalls has an inwardly-extending upper support flange proximate to an upper end. The inwardly-extending upper support flanges are aligned with one another on respective sidewalls. A shelf is mounted between the two upright sidewalls at a position below the inwardly-extending support flanges. The shelf divides the in-ground channel into an upper section and a lower section. The upper section is adapted to house linear lighting and the lower section provides a raceway. The channel has only a single mounting flange attached to one of the two sidewalls at a position level with the bottom. The channel typically also includes a cover adapted to engage the upper support flanges.

The shelf may be fixedly mounted between the two sidewalls, in which case, it may have openings spaced at regular intervals to allow access to the lower section. The shelf may carry linear lighting mounting structure. If the shelf is fixedly mounted with openings, the linear lighting mounting structure may be interrupted by and aligned across the openings.

The shelf may also be removably mounted. In that case, the channel would typically have lower support flanges, one on each sidewall at positions below the upper support flanges. The shelf may be adapted to be supported by the lower support flanges. In some cases, the lower support flanges may define grooves, and the shelf may have depending portions adapted to rest in the grooves.

Other aspects, features, and advantages of the invention will be set forth in the description below.

BRIEF DESCRIPTION OF THE DRAWING FIGURES

The invention will be described with respect to the following drawing figures, in which like numerals represent like features throughout the figures, and in which.

DETAILED DESCRIPTION

Figure 1:
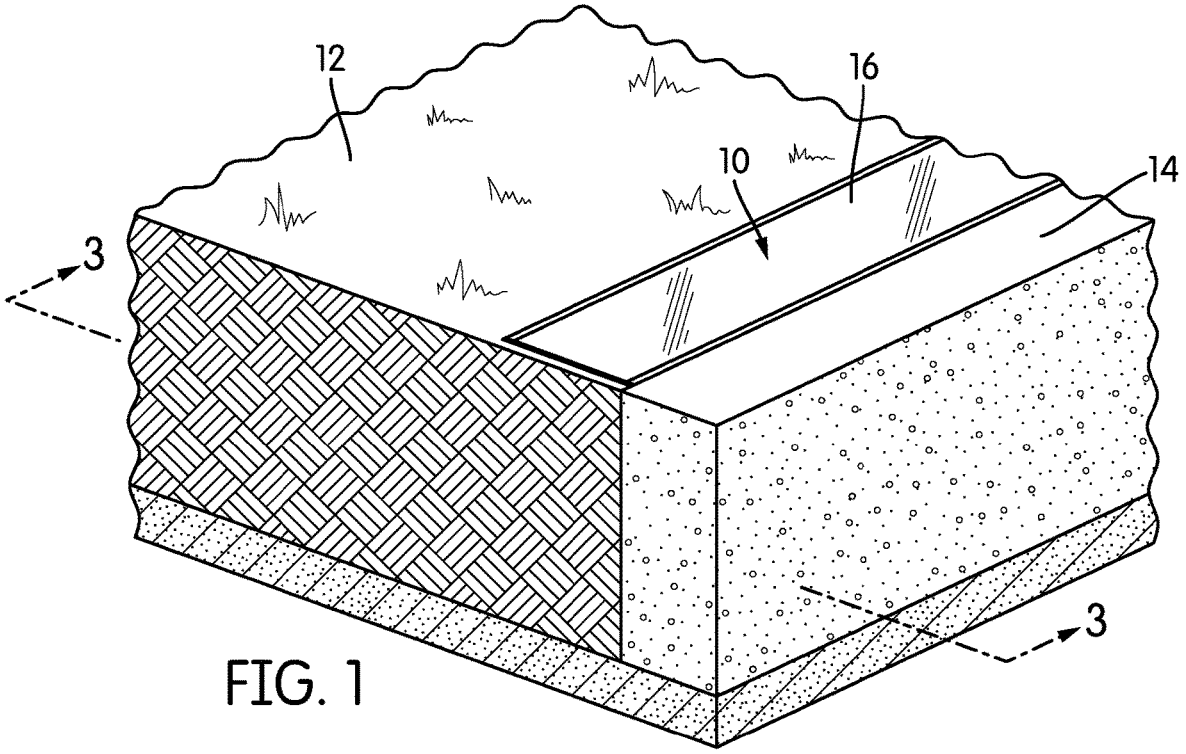
FIG. 1 is a perspective view of a section of ground with an in-ground channel installed therein.

FIG. 1 is a perspective view of a portion of an in-ground channel, generally indicated at 10, according to one embodiment of the invention. As shown, the channel 10 is embedded in the ground, specifically at the interface between grass 12 and concrete 14. In the view of FIG. 1, only the upper lens 16 of the channel 10 is visible.

Figure 2:
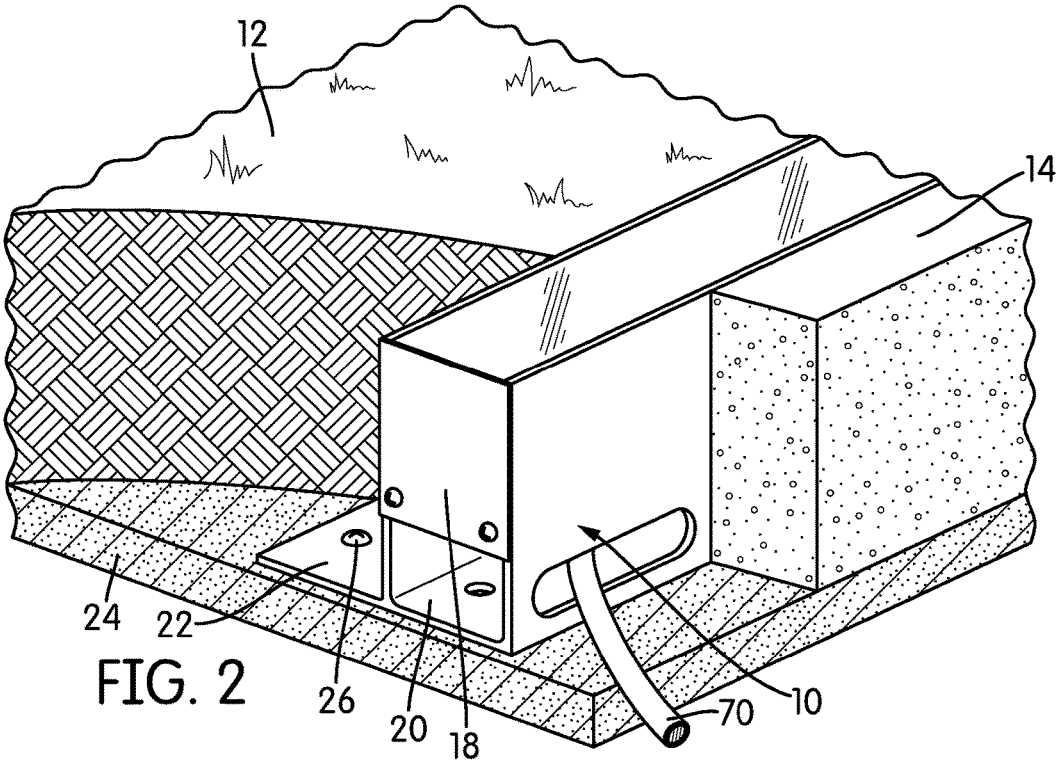
FIG. 2 is a cut-away perspective view of the section of ground of FIG. 1.

FIG. 2 is a perspective view similar to the view of FIG. 1, cut away to show more of the structure of the channel 10. The channel 10 has three major portions: an upper section 18 that houses linear lighting, a lower section 20 that acts as a raceway for wiring and provides drainage, and a flange 22 on one side for securing the channel 10. Depending on the surface on which the channel 10 is mounted, the flange 22 may be secured to the underlying structure 24 with fasteners 26, or it may simply be covered over with concrete, asphalt, or other such materials.

Notably, the illustrated embodiment of the channel 10 has only a single flange 22 on one side. This makes the channel 10 particularly suitable for situations in which it is either inconvenient or impossible to secure the channel 10 on both sides. FIGS. 1 and 2 illustrate this: as was noted above, the channel 10 is secured between grass 12 and concrete 14. There are many situations where, for example, an installer may have permission to dig up grass on private property, but cannot break up a sidewalk, which may be municipal property.

The channel 10 itself would typically be extruded, although it may also be cast or molded. As will be described below in more detail, the channel 10 may be manufactured in particular lengths and joined together to form longer lengths. Many embodiments would be made of metal, e.g., aluminum, stainless steel, and other metals or alloys that can withstand in-ground use. In some cases, the metal may be anodized, powder coated, or otherwise surface-modified for additional protection against its environment. The channel 10 could also be made of plastic, e.g., polycarbonate, ABS, or PVC. The material of which the channel 10 is made in any particular embodiment or installation will depend on a number of factors, including whether the channel 10 must bear a great deal of mechanical force, as would be the case if it were driven over repeatedly. The upper lens 16 of the channel 10 may be made, e.g., of tempered glass or of plastic.

Figure 3:
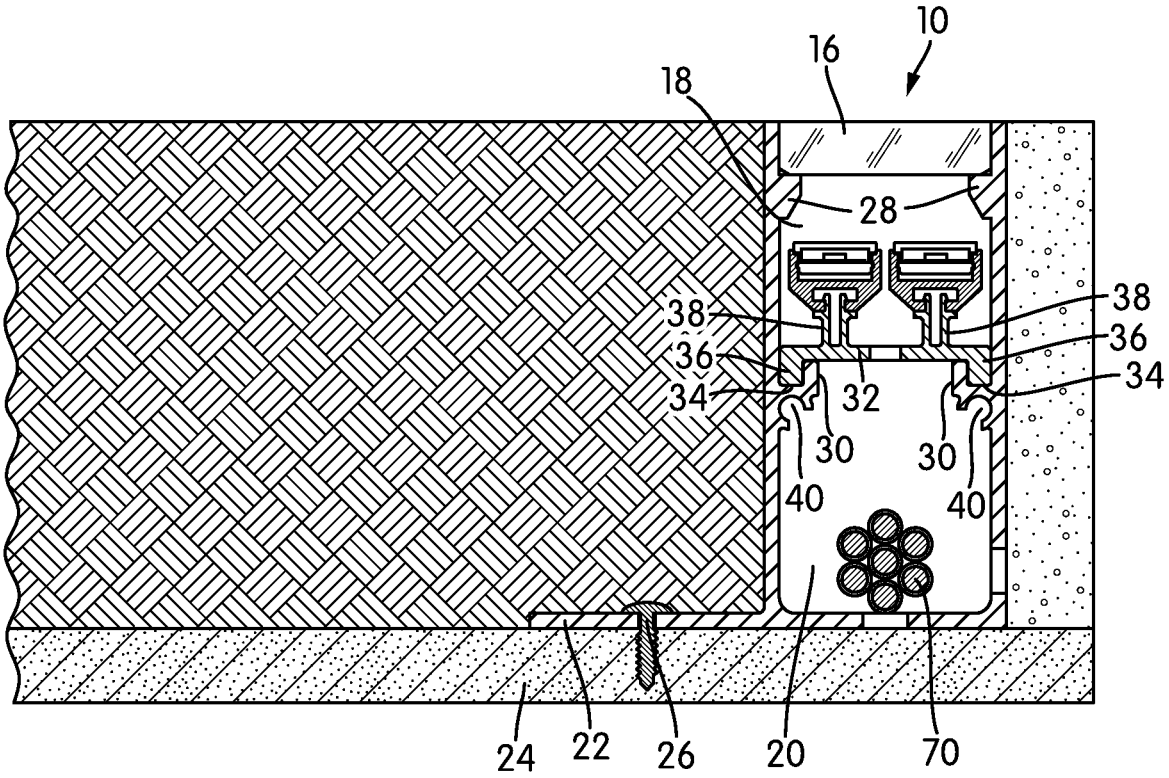
FIG. 3 is a cross-sectional view taken through Line 3-3 of FIG. 1.

FIG. 3 is a cross-sectional view, taken through Line 3-3 of FIG. 1. In the view of FIG. 3, the interiors of the upper section 18 and the lower section are shown 20. The upper lens 16 rests on upper, inwardly-extending flanges 28. Below and spaced from the upper lens 16, a set of lower, inwardly extending flanges 30 support a generally horizontally-extending shelf 32. The upper flanges 28 are different from the lower flanges 30. Specifically, the upper flanges 28 extend straight inwardly, leaving generally flat upper surfaces. The upper lens 16, also generally flat, rests on them. The lower flanges 30, on the other hand, extend inward and make a 90° turn, thus forming a groove 34 in which depending portions 36 of the shelf 32 rest.

Figure 4:
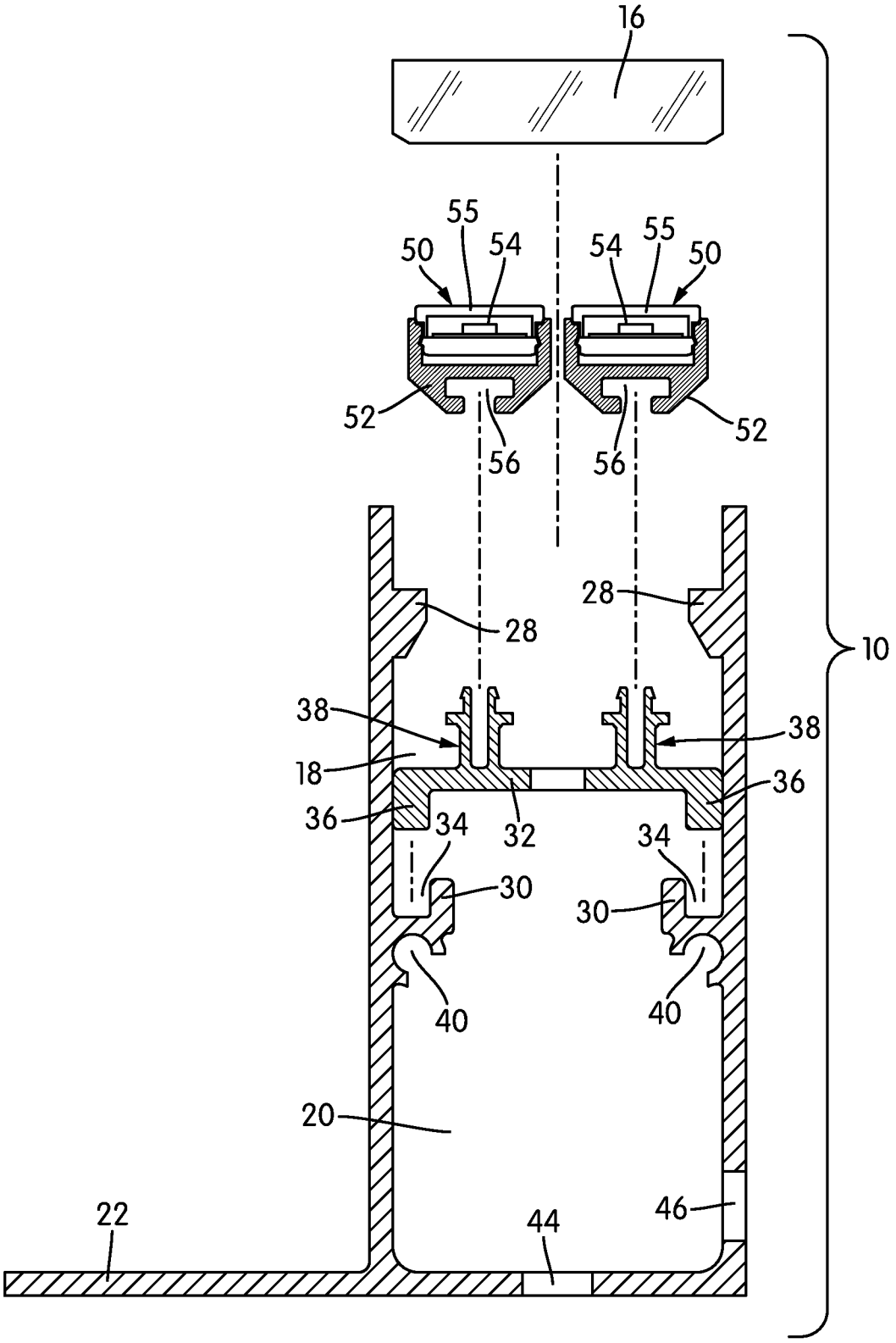
FIG. 4 is an exploded cross-sectional view of the in-ground channel of FIG. 1, shown in isolation.

The shelf 32 acts as the partition between the upper section 18 and the lower section 20 of the channel 10, and also supports linear lighting, as will be described below in more detail. FIG. 4 is an exploded cross-sectional view of the channel 10 in isolation. As can be appreciated from FIG. 3 and also from FIG. 4, the shelf 32 is removable. More specifically, the shelf 32 can be lifted out of the way for access to the lower section 20 and the wire raceway that it provides.

As was described briefly above, the shelf 32 mounts and supports linear lighting. The particular way in which that is done may vary from embodiment to embodiment. Linear lighting may be mounted on the shelf 32 in various ways. For example, in some embodiments, linear lighting may be secured directly to the shelf 32 with adhesive. In other embodiments, the shelf 32 may carry specific mounting structure for mounting specific types of linear lighting.

In the embodiment of FIGS. 1-4, there are two sets of mounting structures 38 side-by-side, defining two positions for mounting linear lighting. In embodiments of the invention, there may be any number of mounting structures for linear lighting, and those structures may differ considerably from embodiment to embodiment.

In a typical installation of the channel 10, some element is encapsulated or sealed to prevent ingress of water, dirt, and other matter from affecting or destroying the linear lighting. In some cases, the upper section 18 of the channel 10 may include seals that give it an appropriate ingress protection rating. However, in the embodiment of FIGS. 1-4, the linear lighting 50 is itself sealed or encapsulated, while the upper section 18 allows drainage into the lower section 20 and out of the channel 10.

Specifically, the linear lighting 50 of the illustrated embodiment comprises a SQUARE CHROMAPATH® BUILDER channel 52 (Elemental LED, Inc., Reno, Nev., United States) with a standard cover 55. The channel 52 itself is an anodized aluminum extrusion. Inside the channel 52 lie one or more strips of linear lighting 54.

In the illustrated embodiment, the linear lighting 54 comprises a printed circuit board (PCB) with LED light engines disposed on the PCB at a regular pitch or spacing. The particular properties of the linear lighting 54 are not critical to the invention, and may vary from embodiment to embodiment and from installation to installation. The linear lighting 54 may accept high voltage or low voltage, and it may emit a single color of light or be adapted to emit any of a variety of colors of light.

Although the definitions of high voltage and low voltage vary depending on the authority one consults, for purposes of this description, the term "high voltage" should be construed to refer to any voltage over about 50V. High-voltage linear lighting typically has additional safety and functional requirements. For example, it may be encapsulated or covered by an electrically-insulative covering. High-voltage linear lighting may directly accept line-voltage, alternating-current (AC) power, the type of power available at the typical household or commercial power outlet, meaning that some types of high-voltage linear lighting may be directly connected to power.

Low-voltage linear lighting typically operates using direct current (DC) power, although some forms of landscape lighting may use low-voltage AC power. In order to convert from line-voltage AC power to low-voltage DC power, some form of driver is typically used. Most modern drivers are switched-mode power supplies, although any components that can rectify and transform AC power may be used. The lower section 20 of the channel 10 may be used to house drivers and other such components, or those components may lie elsewhere, connected to the linear lighting 50 by wires or cables. For example, local electrical code may require a driver to be installed in its own junction box, and may also require separation of high-voltage and low-voltage components. Other components, such as color controllers and network interfaces for the linear lighting, may also be located in the lower section 20, if desired.

In some embodiments, the linear lighting 50 may be encapsulated—i.e., a potting compound, a plastic resin, fills the channel 52 around the strips of linear lighting 54. In other embodiments, the endcaps of the linear lighting 50, which are not shown in the view of FIG. 4, may seal the ends of the channel 52, and the cover 55 may seal the top of the channel 52.

In some cases, the cover 55 merely acts to seal the linear lighting 50. However, in other cases, the cover 55 may act as a diffuser or lens to focus or direct the light that is being emitted by the linear lighting 50. "Diffusion" and "diffuser" as those terms are used here, refer to the spreading or scattering of transmitted or reflected beams of light, typically by transmission through a non-uniform medium or refraction at a non-uniform surface or interface. Diffusion gives the light emerging from a channel a uniform appearance and, preferably, reduces the prominence of the individual spots of light created by the LED light engines. A typical diffusing cover is at least somewhat opaque—filled with a colorant or dye that causes light scattering. In some cases, covers 55 according to embodiments of the invention may have the attributes of lenses or prisms, typically to add to the diffusion by spreading the light, although the selectively thickened portions of lenses or prisms may also provide for greater diffusion simply because the light must pass through more material. Lenses or prisms may also be used to direct the light in some embodiments, or to establish a particular beam angle, and may or may not be opaque. The term "lens," as used in this description, refers to an element with at least one curved surface that is intended to refract and direct light. The term "prism," as used in this description, refers to an element with flat, angled sides that is intended to refract and direct light.

As those of skill in the art will realize, there are may be two lenses in the channel 10: the cover 55 and the upper lens 16. In some embodiments, the two lenses may cooperate to achieve a desired effect, such as full diffusion or a particular beam angle for the emitted light.

The channel 52 has a T-slot 56 in its bottom that the mounting structures 38 are adapted to engage. Notably, the mounting structures 38 themselves are not complementary T-shapes; rather, they are double-pronged structures with outward barbs that deflect inwardly to snap the channel 52 into place. If the mounting structures 38 did have a solid T-shape, the channel 52 could still be mounted, but the mounting would likely be by a slide-in connection.

Figure 5:
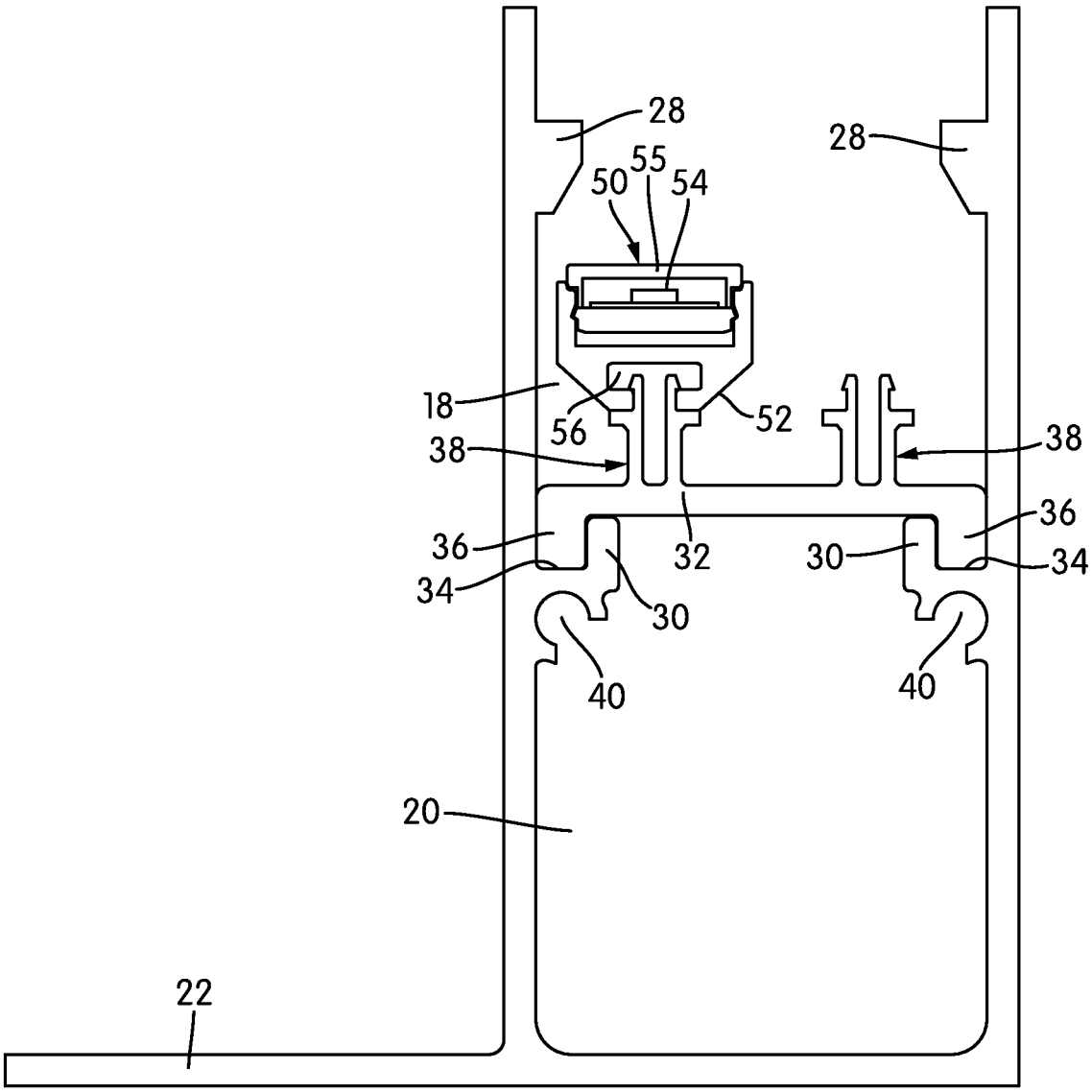
FIGS. 5-7 are end-elevational views of the in-ground channel with one or two strips of linear lighting installed in various positions.
Figure 6:
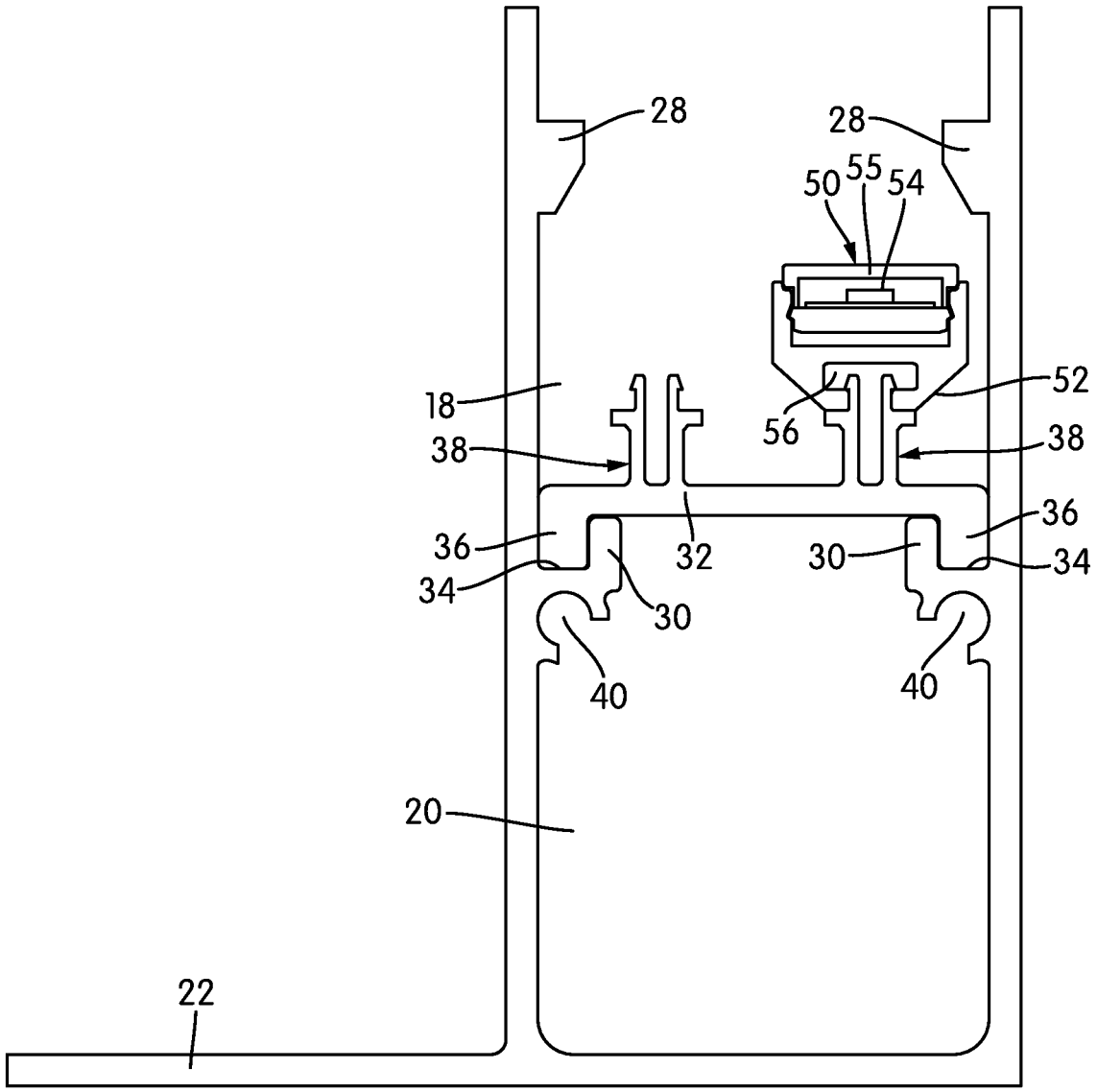
Figure 7:
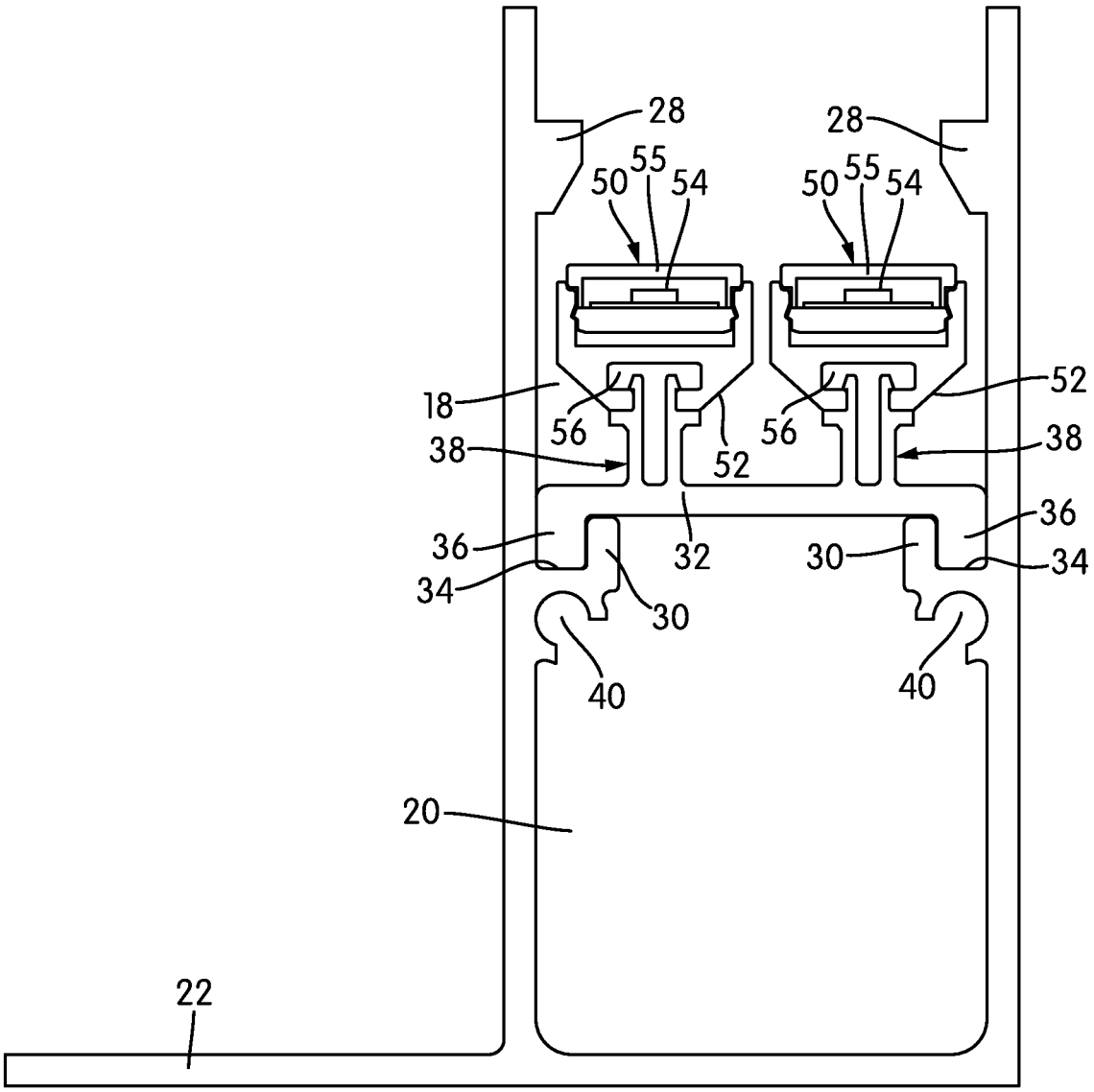

The advantage of having complementary mounting structures 38, 56 is that sections of linear lighting 50 can be easily placed, removed, and replaced. In other words, complementary mounting structures 38, 56 provide for a degree of modularity. As shown in FIGS. 5-7, which are side elevational views of the channel 10, linear lighting 50 may be installed on either mounting structure 38 or on both mounting structures 38. However, mounting structures 38 are not necessary in all embodiments. In lieu of mounting structures 38, linear lighting may be directly mounted on the shelf by use of adhesive, caulk, and other such compounds.

In the illustrated embodiment, there are two mounting structures 38 and the channel 10 has the width to accommodate two strips of linear lighting 38. In other embodiments, there may be only one mounting structure 38, or there may be multiple mounting structures 38, i.e., more than two.

Figure 8:
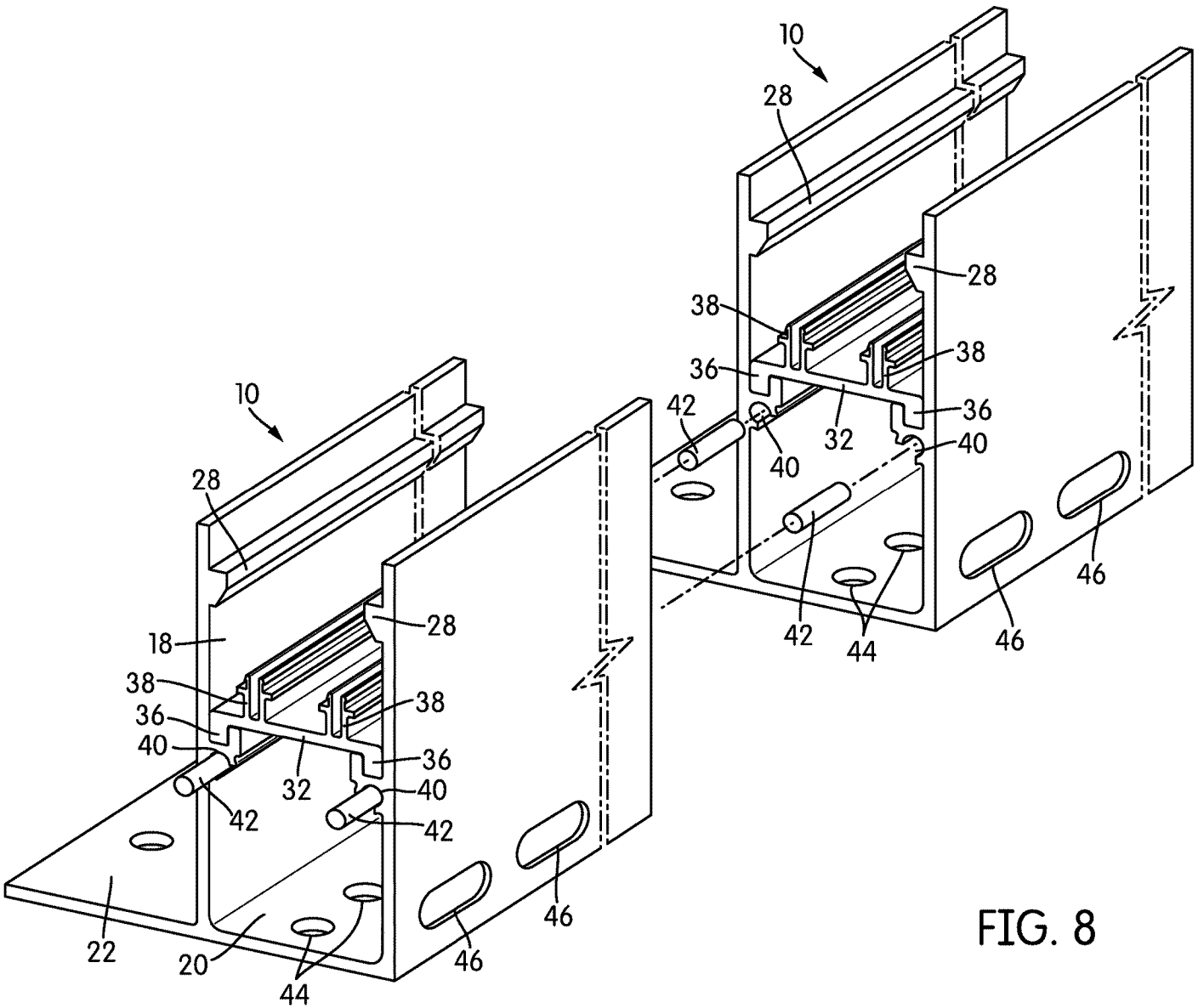
FIG. 8 is a perspective view illustrating the process of aligning and joining two in-ground channels.

As shown in the figures, the flanges 30 that create channels 34 for the shelf 32 have another feature on their undersides: a set of partially circular alignment channels 40, positioned at the top of the lower section 40, that can be used for alignment pins. Typically, the channel 10 will be manufactured in certain lengths, and can be cut to shorter lengths. FIG. 8 is an exploded perspective view of two channels 10 showing how they are connected to create longer lengths. Specifically, dowel-shaped alignment pins 42 are inserted into the alignment channels 40 to align the two adjacent channels 10.

As was described above, in use, drainage holes 44 may be provided at regular intervals along the channels 10, typically in the lower section 20, although in some cases, drainage holes 44 may be provided in the upper section 18 as well. Additionally, wires 70 (shown in FIGS. 2 and 3) may exit the lower section 20 of the channel 10 at its ends or through wire access holes 46 in the sidewalls of the lower section 20. Each channel 10 may have some drainage holes 44. However, openings need not always be present in the channel 10 at the time of manufacture. In some cases, there may be frangible portions that are punched out in the field prior to or during installation to form the wire access holes 46, and in some cases, drainage holes 44. In other cases, the channel 10 may simply be drilled in the field to form any necessary openings. If openings, like the wire access holes 46, are pre-formed in the channel 10, covers may be provided to seal any unneeded openings.

Figure 9:
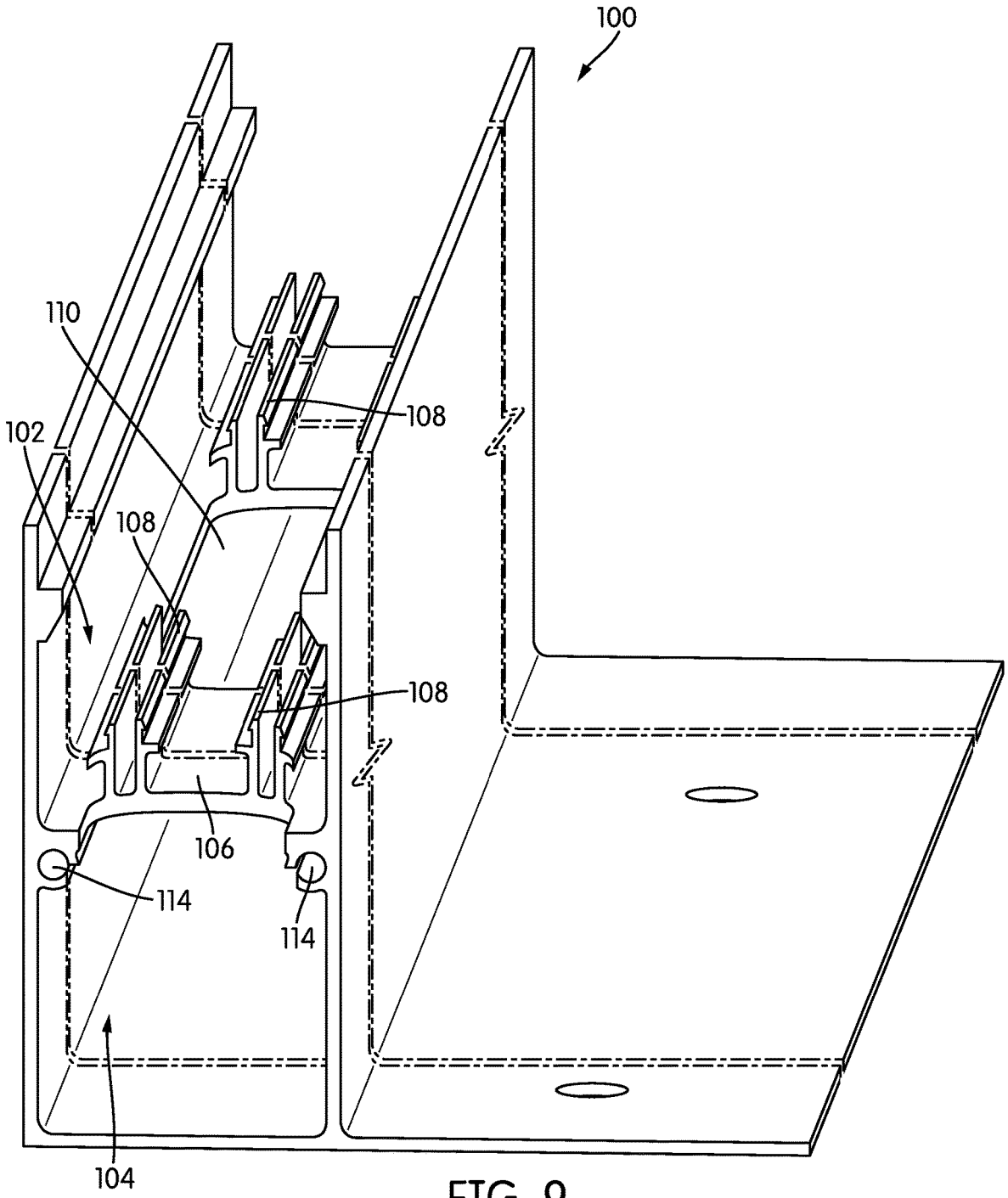
FIG. 9 is a perspective view of an in-ground channel according to another embodiment of the invention.

FIG. 9 is a perspective view of a channel, generally indicated at 100, according to another embodiment of the invention. The channel 100 has many of the same features as the channel 10 described above; therefore, the description above will suffice for those features not described here. The channel 100 has an upper section 102 and a lower section 104. As in the channel 10 described above, the upper section 102 houses linear lighting, while the lower section 104 acts as a raceway for wires and provides for better drainage.

The boundary between the upper section 102 and the lower section 104 is a generally horizontal shelf 106 that carries mounting structure 108 for linear lighting 50. However, unlike in the channel 10 described above, the shelf 106 is not removable; instead, it is fixed to the sidewalls of the channel 100.

Figure 10:
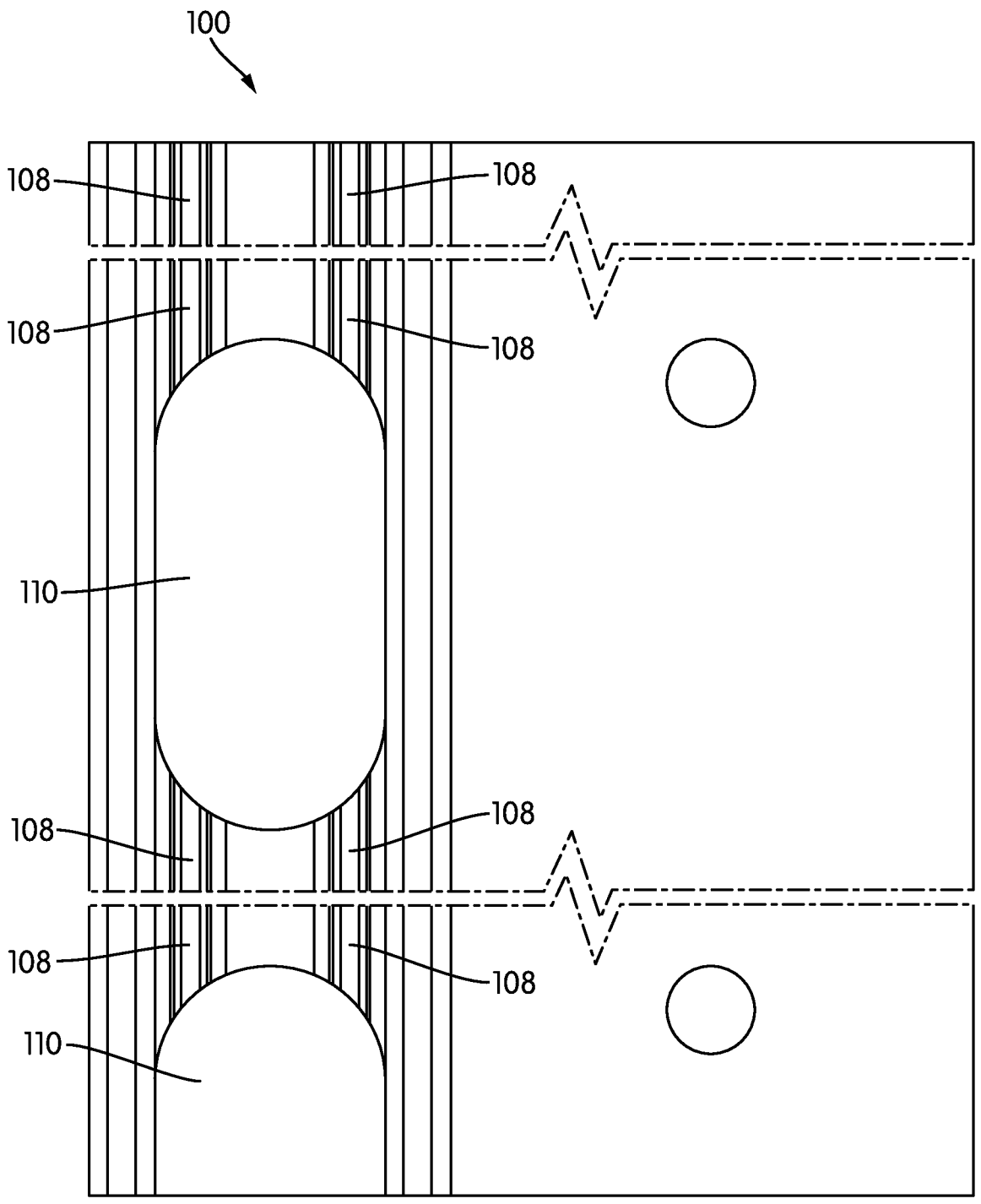
FIG. 10 is a top plan view of the in-ground channel of FIG. 9.

Since the shelf 106 is not removable, it could potentially block access to the lower section 104 of the channel 100. Thus, in order to provide access to the lower section 104, for example, to place or connect wiring, the shelf 106 includes relatively large openings 110 at regular intervals along the length of the channel 100. These openings 110 can be seen in FIG. 9 and in the top plan view of FIG. 10. In the channel 100, the openings have long, straight sides and rounded corners. The openings 110 may have essentially any shape in other embodiments, although it may be helpful to avoid sharp corners and other structure that could potentially abrade or crimp a wire. In some embodiments, openings 110 may consume up to 50% of the surface area of the shelf 106. In general, there is no particular limit to the surface area that may be consumed by the openings 110, so long as sufficient shelf 106 and mounting structure remains to secure the linear lighting 50.

The mounting structure 108 is similar to the mounting structure 38 described above. However, the mounting structure 108 is interrupted by the openings 110. Thus, instead of a continuous line, individual segments of the mounting structure 108 are aligned with one another across the openings 110. Channels 114 for alignment pins to connect adjacent sections of the channel 100 are carried on the underside of the shelf 106.

Figure 11:
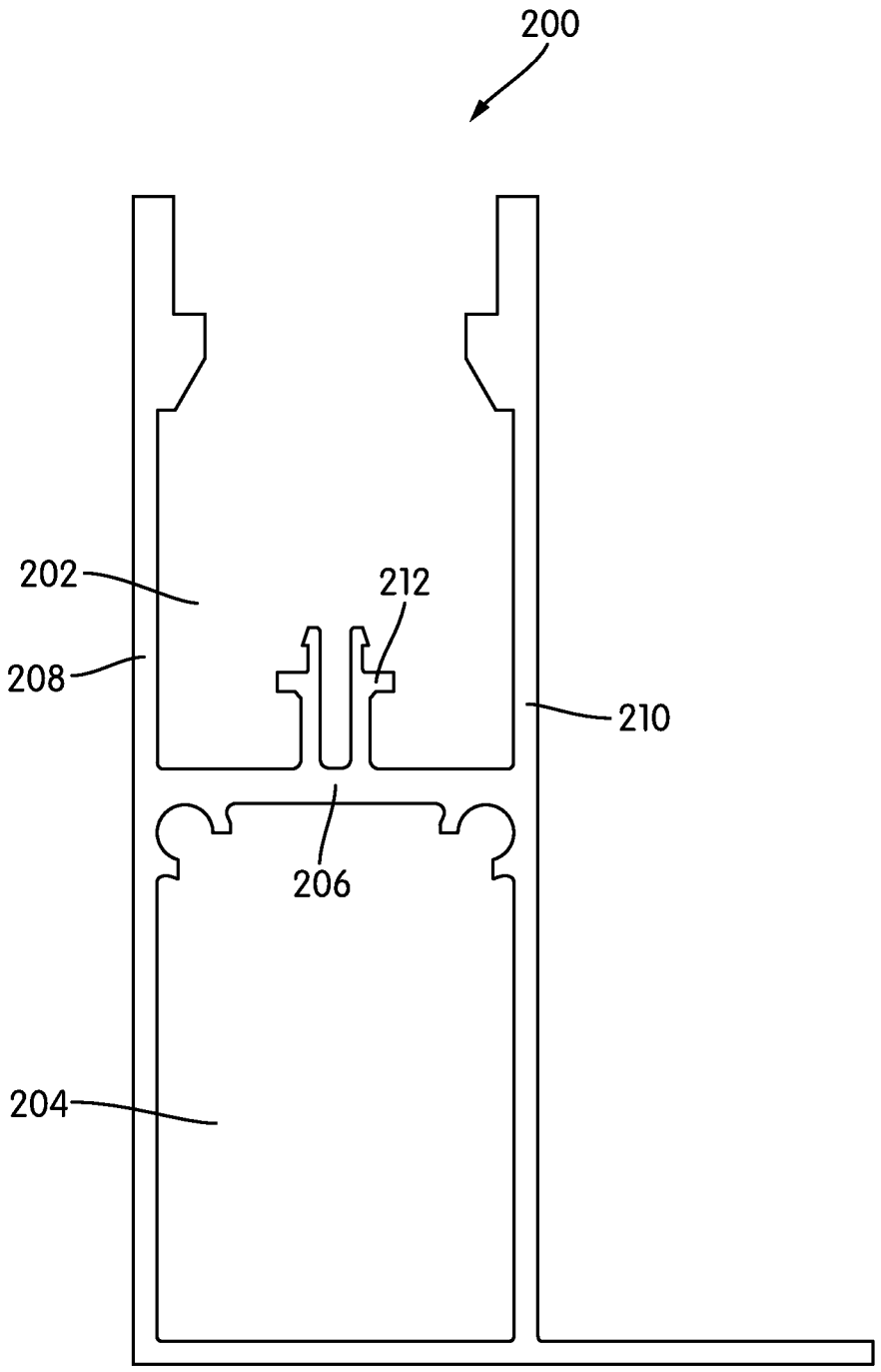
FIG. 11 is a side elevational view of a channel according to yet another embodiment of the invention.

FIG. 11 is an illustration of a channel, generally indicated at 200, according to yet another embodiment of the invention. The channel 200 has an upper section 202, a lower section 204, a fixed shelf 206 mounted between the sidewalls 208, 210 of the channel 200. A single mounting structure 212 is centered on the shelf 206.

While the invention has been described with respect to certain embodiments, the description is intended to be exemplary, rather than limiting. Modifications and changes may be made within the scope of the invention, which is defined by the appended claims.

What is claimed is:

1. An in-ground channel for linear lighting, comprising:

two upright sidewalls spaced apart by a bottom, each of the sidewalls having an inwardly-extending upper support flange proximate to an upper end thereof, the inwardly-extending upper support flanges being aligned with one another on respective sidewalls;

a shelf mounted between the two upright sidewalls at a position below the inwardly-extending support flanges, the shelf dividing the in-ground channel into an upper section and a lower section, the upper section adapted to house linear lighting and the lower section providing a raceway; and only a single mounting flange attached to one of the two sidewalls at a position level with the bottom.

2. The in-ground channel of claim 1, further comprising an inwardly-extending lower support flange on each of the two sidewalls, the inwardly-extending lower support flanges being aligned with one another below the inwardly-extending upper support flanges.

3. The in-ground channel of claim 2, wherein the shelf is removably supported by the inwardly-extending lower support flanges.

4. The in-ground channel of claim 3, wherein the inwardly-extending lower support flanges form grooves.

5. The in-ground channel of claim 4, wherein depending portions of the shelf rest in the grooves.

6. The in-ground channel of claim 1, wherein the shelf is fixed between the two sidewalls.

7. The in-ground channel of claim 6, wherein the shelf includes at least one opening that provides access to the raceway.

8. The in-ground channel of claim 7, wherein the shelf includes a plurality of openings spaced at a regular interval from one another along a length of the shelf.

9. The in-ground channel of claim 1, wherein the lower section includes one or more drainage holes.

10. The in-ground channel of claim 1, further comprising a cover adapted to engage the upper support flanges.

11. The in-ground channel of claim 1, further comprising linear lighting mounting structure on the shelf.

12. The in-ground channel of claim 11, wherein the linear lighting mounting structure comprises snap-fit structure adapted to engage a T-slot.

13. An in-ground channel for linear lighting, comprising:

two upright sidewalls spaced apart by a bottom, each of the sidewalls having a pair of inwardly-extending upper support flanges proximate to an upper end thereof, the pair of inwardly-extending upper support flanges being aligned with one another on respective sidewalls, a pair of inwardly-extending lower support flanges;

a shelf removably mounted on the pair of inwardly-extending lower support flanges, the shelf dividing the in-ground channel into an upper section and a lower section, the upper section adapted to house linear lighting and the lower section providing a raceway;

only a single mounting flange attached to one of the two sidewalls at a position level with the bottom; and a cover adapted to engage the pair of inwardly-extending upper support flanges.

14. The in-ground channel of claim 13, wherein the pair of inwardly-extending lower support flanges form grooves.

15. The in-ground channel of claim 14, wherein depending portions of the shelf rest in the grooves.

16. The in-ground channel of claim 13, further comprising linear lighting mounting structure on the shelf.

17. The in-ground channel of claim 16, wherein the linear lighting mounting structure comprises snap-fit structure adapted to engage a T-slot.

18. An in-ground channel for linear lighting, comprising:

two upright sidewalls spaced apart by a bottom, each of the sidewalls having a pair of inwardly-extending upper support flanges proximate to an upper end thereof, the pair of inwardly-extending upper support flanges being aligned with one another on respective sidewalls;

a shelf fixedly mounted between the two upright sidewalls at a position below the pair of inwardly-extending support flanges, the shelf dividing the in-ground channel into an upper section and a lower section, the upper section adapted to house linear lighting and the lower section providing a raceway, the shelf having openings therein at regular intervals;

linear lighting mounting structure on the shelf, the linear lighting mounting structure extending substantially the entirety of a length of the shelf, interrupted by but aligned across the openings; and only a single mounting flange attached to one of the two sidewalls at a position level with the bottom.

19. The in-ground channel of claim 18, further comprising a cover adapted to engage the upper support flanges.

20. The in-ground channel of claim 18, wherein the linear lighting mounting structure comprises snap-fit structure adapted to engage a T-slot.

* * * * *